US010415589B2

(12) United States Patent
Boehm et al.

(10) Patent No.: US 10,415,589 B2
(45) Date of Patent: Sep. 17, 2019

(54) PLASTIC PUMP HOUSING CONSISTING OF AN INNER CASING, AN OUTER CASING AND FILLING MATERIAL THEREBETWEEN

(71) Applicant: KSB Aktiengesellschaft, Frankenthal (DE)

(72) Inventors: Alexander Boehm, Frankenthal (DE); Armin Gaiser, Frankenthal (DE); Sven Kilian, Frankenthal (DE); Karl-Heinz Koefler, Frankenthal (DE); Alexander Puetterich, Frankenthal (DE); Schramm Bernd, Frankenthal (DE); Andrea Seemann, Frankenthal (DE); Markus Steffens, Kaiserslautern (DE); Frank Anna, Kaiserslautern (DE)

(73) Assignee: KSB Aktiengesellschaft, Frankenthal (DE)

( * ) Notice: Subject to any disclaimer, the term of this patent is extended or adjusted under 35 U.S.C. 154(b) by 475 days.

(21) Appl. No.: 15/102,055

(22) PCT Filed: Dec. 5, 2014

(86) PCT No.: PCT/EP2014/076706
§ 371 (c)(1),
(2) Date: Jun. 6, 2016

(87) PCT Pub. No.: WO2015/082679
PCT Pub. Date: Jun. 11, 2015

(65) Prior Publication Data

US 2016/0312794 A1 Oct. 27, 2016

(30) Foreign Application Priority Data

Dec. 6, 2013 (DE) ..... 10 2013 225 065

(51) Int. Cl.
*F04D 29/42* (2006.01)
*F04D 29/58* (2006.01)
(Continued)

(52) U.S. Cl.
CPC ..... *F04D 29/426* (2013.01); *F04D 1/063* (2013.01); *F04D 29/026* (2013.01);
(Continued)

(58) Field of Classification Search
CPC .. F04D 29/026; F04D 29/426; F04D 29/4286; F04D 29/5893; F04D 1/063
See application file for complete search history.

(56) References Cited

U.S. PATENT DOCUMENTS 3,876,327 A * 4/1975 Lobanoff ..... F04D 29/026 156/172
4,806,083 A * 2/1989 LaGrange ..... F04B 53/00 264/272.2
(Continued)

FOREIGN PATENT DOCUMENTS

DE 1 096 753 1/1961
DE 199 53 911 A1 11/2000
(Continued)

OTHER PUBLICATIONS

International Preliminary Report on Patentability (PCT/IB/373) issued in PCT Application No. PCT/EP2014/076706 dated Jun. 7, 2016, including English translation of document C2 (German-language Written Opinion (PCT/ISA/237)) previously filed Jun. 6, 2016 (eight (8) pages).
(Continued)

*Primary Examiner* — David E Sosnowski
*Assistant Examiner* — Brian P Wolcott
(74) *Attorney, Agent, or Firm* — Crowell & Moring LLP

(57) ABSTRACT

A pump housing made of plastic sections is provided. The housing includes a first casing that has a first side facing the region in which a pumped medium will flow, and a second casing that has a second side facing the environment. The pump housing's first casing and second casing are both
(Continued)

dimensionally stable, with a space between the first casing and the second casing. A filler material such as a self-expanding foam may be provided in the space. The pump casings may be standardized components, and multiple casings may be assembled to form pump housings to suit a particular application.

11 Claims, 2 Drawing Sheets

(51) Int. Cl.
*F04D 1/06* (2006.01)
*F04D 29/02* (2006.01)

(52) U.S. Cl.
CPC ..... *F04D 29/4286* (2013.01); *F04D 29/5893* (2013.01); *F05B 2230/60* (2013.01); *F05B 2240/14* (2013.01); *F05B 2280/4003* (2013.01); *F05B 2280/4011* (2013.01); *F05B 2280/6003* (2013.01); *F05B 2280/6012* (2013.01); *F05D 2300/43* (2013.01); *F05D 2300/603* (2013.01)

(56) References Cited

U.S. PATENT DOCUMENTS

| | | | | |
|---|---|---|---|---|
| 4,923,367 A | | 5/1990 | Zimmer | |
| 6,068,455 A | * | 5/2000 | Cowans | F04D 29/5893 417/357 |

FOREIGN PATENT DOCUMENTS

| | | | | |
|---|---|---|---|---|
| EP | 0 206 031 A1 | | 12/1986 | |
| EP | 0 797 737 B1 | | 3/1999 | |
| EP | 1 203 887 A2 | | 5/2002 | |
| EP | 1 647 718 A1 | | 4/2006 | |
| EP | 1647718 A1 | * | 4/2006 | F04D 29/5893 |
| EP | 1 972 788 A1 | | 9/2008 | |
| EP | 2 236 839 A1 | | 10/2010 | |
| EP | 2236839 A1 | * | 10/2010 | F04D 29/426 |
| JP | 2011-208621 A | | 10/2011 | |

OTHER PUBLICATIONS

International Search Report (PCT/ISA/210) issued in PCT Application No. PCT/EP2014/076706 dated Feb. 4, 2015, with English translation (six (6) pages).

German-language Written Opinion (PCT/ISA/237) issued in PCT Application No. PCT/EP2014/076706 dated Feb. 4, 2015 (six (6) pages).

German Office Action issued in counterpart German Application No. 10 2013 225 065.7 dated Jul. 25, 2014 (four (4) pages).

English translation of Japanese Office Action issued in counterpart Japanese Application No. 2016-536130 dated Jun. 30, 2017 (four pages).

* cited by examiner

PLASTIC PUMP HOUSING CONSISTING OF AN INNER CASING, AN OUTER CASING AND FILLING MATERIAL THEREBETWEEN

CROSS REFERENCE TO RELATED APPLICATIONS

This application is a National Stage of PCT International Application No. PCT/EP2014/076706, filed Dec. 5, 2014, which claims priority under 35 U.S.C. § 119 from German Patent Application No. 10 2013 225 065.7, filed Dec. 6, 2013, the entire disclosures of which are herein expressly incorporated by reference.

The invention relates to a housing for a centrifugal pump, and to a method for producing a housing for a centrifugal pump.

Housings for centrifugal pumps are known in various embodiments. Depending on the conditions in which it is used, that is to say the working pressure, the pumped medium, the temperature of the medium or the like, the housing is produced from special materials. The static structural design of the housing is likewise greatly dependent on the area of use.

The present invention relates to pump housings in the area of aggressive media, the pump housing using for a material which is not corroded by these pumped media.

A simple form of corrosive protection is represented by pumps known as liner pumps. With these, the inner region of the pump that is in contact with the medium is lined with a plastic. It is disadvantageous that under some circumstances the housing is still externally exposed to corrosion. European patent document no. EP 0 206 031 A1 discloses such a lining of a pump housing that is provided with strengthening elements. The outer housing is in this case still of a conventional design. Differences in pressure within the housing mean that there is the risk of the liner becoming detached.

Housings that are produced entirely from plastic likewise stop this from happening, but in the case of more complex forms of housing a considerable effort is required in production. European patent document no. EP 1 972 788 A1 shows for example a housing of plastic having a number of parts, the housing being divided to make it easy for wearing parts to be exchanged.

European patent documents no. EP 0 797 737 B1 shows a housing with a plastic inner housing, the outer housing of which can be advantageously dismantled, it likewise being intended for an exchange of the inner housing to be easily achievable. Here, too, the inner housing and the outer housing lie against one another with a form fit. As in the case of all coatings, there is the risk of corrosion occurring between the housing and the coating, as a result of which the coating may become detached. If the coating is damaged, corrosion may likewise occur on the housing.

German patent document no. DE 1096753 describes a wear-resistant centrifugal pump for pumping coarse material with a wear insert of rubber, with a number of anchored profile strips lying next to one another.

An object of the present invention is to produce a pump housing made of plastic, the housing having a first casing with a first side facing the pumped medium, the housing having a second casing with a second side facing the environment. The pump housing is intended to be stable and able to be produced inexpensively.

This object is achieved in the case of the pump housing by the first and second casings each being designed to be dimensionally stable and there being a spacing between the first casing and the second casing. This offers the advantage that the two casings can be produced independently of one another, it being possible in particular in the production of plastic parts for the respective contour to be produced in a simple laminating process, since the inner form of the housing and the outer form of the housing are independent of one another. The spacing between the first casing and the second casing is provided with a filling material. This filling material initially provides a support for the two casings on one another. In addition, a filling material may be chosen such that possible vibrations between the two casings are reduced by damping in the filling material. A further possibility is presented by heat transmission between the two casings being reduced by a corresponding heat-insulating filling material.

In a refinement of the invention, the first casing and/or the second casing of the pump housing is/are made up of segments. This offers the advantage that individual parts can be easily produced. The individual segment may be designed such that its form entirely avoids undercuts.

In a further refinement of the invention, the filling material is a self-expanding foam, in particular a foam that expands without any buildup of pressure. The advantage of the self-expanding foam is the already mentioned expansion without any buildup of pressure. As a result, damage to the casings is avoided. A further advantage is that there is no need for laborious machining of the foam core, which would be necessary if already expanded foam were used. Furthermore, a self-expanding epoxy-resin foam has very good mechanical properties in comparison with conventional foams, such as for example polyurethane foam. Moreover, it is inexpensive.

In a further refinement, the individual segments can be connected by connection flanges, which make an exactly fitting arrangement of the individual segments possible, this being necessary for optimal hydraulic functioning. In addition, the connection flanges may incorporate sealing devices, which seal off the housing as a whole. As and when required, stabilizing elements can be incorporated in the connection flanges.

In a further refinement, reinforcing elements which lend the housing as a whole sufficient stability are provided in the spacing between the first casing and the second casing. In particular, connecting elements which transmit both tensile forces and compressive forces can be provided between the two casings.

In a further refinement, the first casing and/or the second casing is/are produced from fiber-reinforced composite material, the fibers consisting of glass, carbon, boron or aramid. The associated matrix system consists of a thermoplastic, for example polypropylene (PP) polyamide (PA), polyethylene (PE), polycarbonate (PC), styrene acrylonitrile (SAN), polybutylene terephthalate (PBT), polyphenylene sulfide (PPS) or the like or of a thermoset, such as for example epoxy (EP), unsaturated polyester (UP), vinyl ester (VE), phenol formaldehyde (PF), polyurethane (PU) or something comparable, which embeds the fibers. As a result, an ideally adapted solution for the respective application of the pump can be found for the design of the pump housing. Allowance is made for compressive loading, in dependence on the delivery head of the pump, vibrations that act on the housing and influences of the pumped medium, for which reason particular chemical or thermal stability may be necessary.

In a particularly advantageous refinement, a pump housing can be constructed from a number of geometrically identical segments. This makes the production of the housing much easier. A number of identical segments can be prepared in parallel; for diversification, specific segments that allow for the properties of a specific pump may be incorporated in the housing as a whole. Thus, a very large number of different pump housings, which can be adapted to virtually any desired application area, can be produced from a stock of standardized segments by adding the specific parts.

The pump housings that are produced in accordance with the invention may be constructed as a combination of plastic parts and metal components. They may be provided both on their outer side and on the inner side, which is facing the pumped medium, with an in situ coating, which is impermeable to the respective medium. For example, by means of a gelcoat coating, the surface becomes fluid-impermeable and particularly smooth, and it is also prevented that individual fibers are exposed. Similarly, surfaces that are very stable and do not react either mechanically or chemically with the pumped medium may be provided, for example an additional coating that is suitable for drinking water may be provided; other coatings may have the effect of reducing abrasion.

Furthermore, the invention relates to a method for producing a pump housing described above, wherein in a first step the geometrical form of the housing is established, wherein a hydraulically and mechanically optimized form that is based on the usual rules of structural design is determined, subsequently in a further step this geometrical form is divided up into segments in such a way that in each segment there is no undercut. This simplifies the production of the segment in such a way as to make complex fashioning of a casting mold with a core or re-working of the component avoidable. In a next step, the individual segments are produced from a composite material, wherein connection flanges are formed. In a next step, the segments are joined to form a housing component, wherein in each case a first casing and a second casing are formed, creating a spacing between the first casing and the second casing that is provided with a filling material in a further step.

Other objects, advantages and novel features of the present invention will become apparent from the following detailed description of one or more preferred embodiments when considered in conjunction with the accompanying drawings.

DETAILED DESCRIPTION

Figure 1:
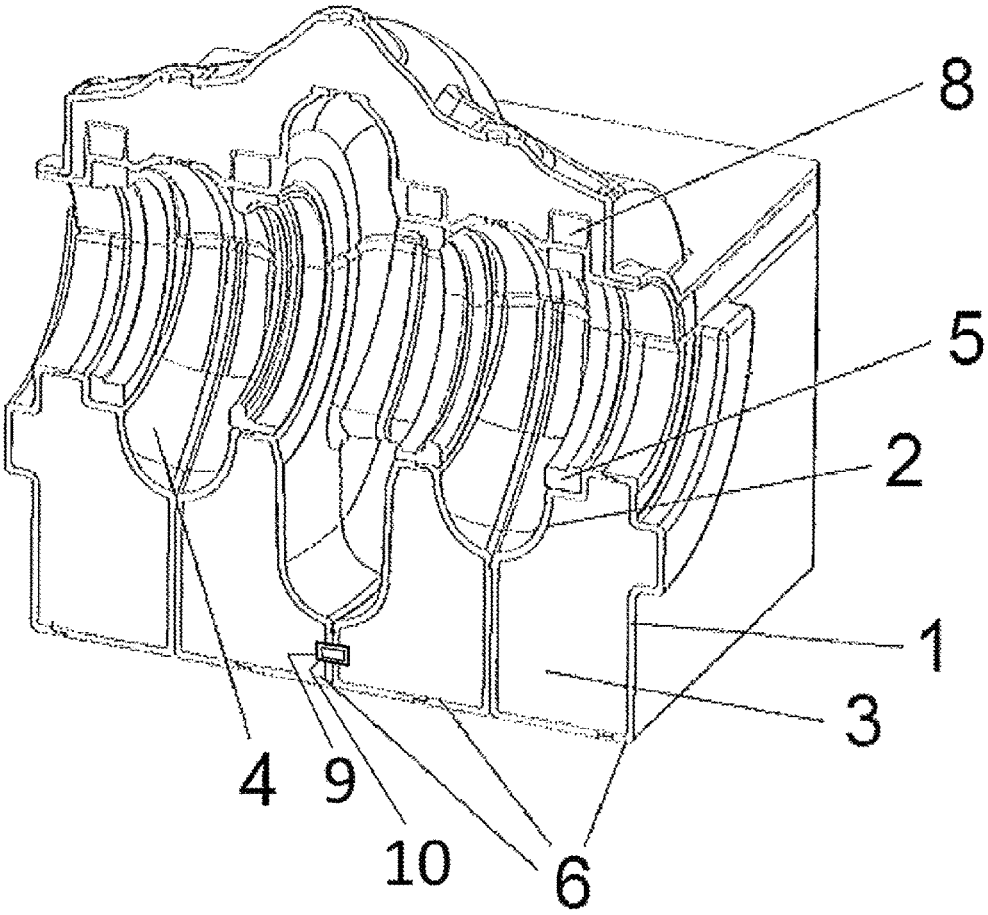
FIG. 1 shows a housing according to an embodiment of the invention of a centrifugal pump.

An embodiment of a housing according to the invention of a centrifugal pump is represented in FIG. 1. The housing is constructed from individual casings 1, 2, which are produced from a fiber-reinforced plastic, for example from glass-fiber fabric with epoxy resin or vinyl-ester resin. The individual parts of the casings are produced in a customary laminating process, with hand lay-up processes, transfer molding (RTM), reaction injection molding or vacuum infusion processes being particularly suitable for this. All of the processes are aimed at creating as far as possible an approximately 10 mm thick casing which is produced in a mold that is free from inclusions or bubbles. The side of the surface that is facing the mold becomes very smooth, for which reason it can be used without re-working, or with only little re-working, both as a surface for the pump chamber and as a contact surface between the casings. The opposite surface of the respective casing tends to be rough and does not need to be worked any further. The casings 1, 2 are connected such that the two rough sides face one another. The connection may in this case be of a releasable or permanent form. The cavity created between an outer casing 1 and an inner casing 2 is filled with a foam 3. This foam preferably bonds with the rough surface and expands without any further buildup of pressure. Polyurethane foam or epoxy-resin foam will preferably be used for this.

The upper part of the housing is of a one-part design, while the lower part of the housing is made up of a number of segments 6. The segments 6 are cut to size so as to form the desired pump chamber 4, it having been ensured that the geometry of the individual segments does not need any undercuts, making production much easier. A sealing arrangement, which as and when required may be arranged in specially shaped sealing grooves, may be additionally provided between the individual segments 6. The connection of the segments may either take place releasably by screws or else non-releasably, for example by adhesive bonding.

According to the invention, the segments 6 of the lower part of the housing may be designed such that identical parts can be used. For example, there are segments that are suitable for the periphery and segments that provide the pump chamber for individual pump stages. Depending on the number of pump stages, any number of the latter segments can be arranged between the former segments. The parts themselves may be produced identically in production. The upper part of the housing would then have to be produced suitably for each pump according to the number of stages. The upper and lower parts of the housing are advantageously provided with a seal and releasably connected to one another.

Provided in the upper part of the housing are various inlays 8, which serve for the mechanical stiffening of the housing part. In the present exemplary embodiment, these inlays 8 are designed as 40 mm thick metal parts. The parts are exactly positioned, the respective position being chosen with a view to an advantageous distribution of forces occurring and the reduction of vibrations. The positioned inlays 8 are laminated in their position into the housing part before the segment is provided with the expanding foam. In a similar way, flanges 7 for connection to adjacent components are incorporated in the housing. These flanges are for example laminated as metal parts into a casing 1 and subsequently provided with possibly necessary bore holes.

Producing the individual segments 6 in a laminating mold provides good fitting accuracy, which makes the fitting of split rings 5 in the pump chamber 4 much easier. Before the final assembly of the housing, the split rings 5 can be fastened in their respective position. These rings are then fixed in an accurately fitting and sealed manner in the finished housing.

Fastening structures can be provided on the housing that is represented in FIG. 1, it being possible for these structures to be likewise supported by laminated-in metal parts. For example, the underside can be provided with standing feet, which are strengthened by a corresponding metal inlay in the segments 6 of the lower part of the housing.

Figure 2:
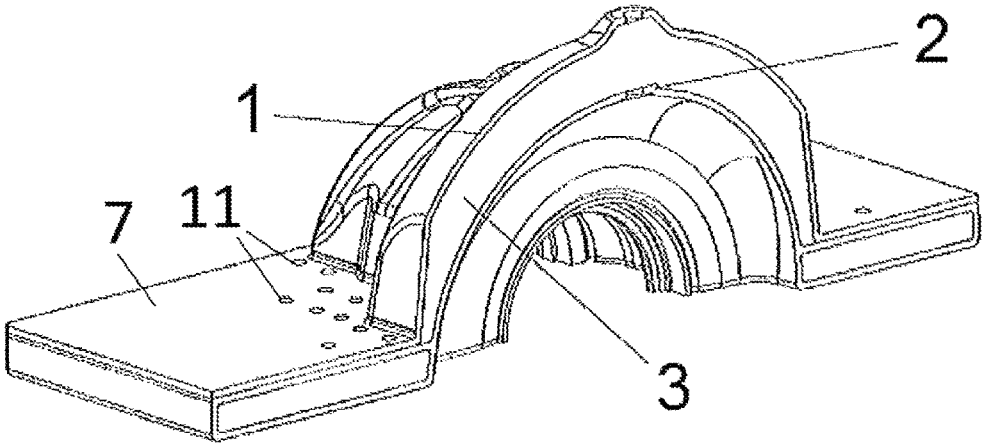
FIG. 2 shows a detail of the FIG. 1 embodiment.

FIG. 2 shows the upper part of the housing of FIG. 1, consisting of the outer casing 1 and the inner casing 2. The intermediate space is filled with the foam 3. Various bore holes for fastening for example to the lower part are represented in this view of a detail.

| List of designations | |
|---|---|
| 1 | outer casing |
| 2 | inner casing |
| 3 | foam |
| 4 | pump chamber |
| 5 | split ring |
| 6 | segment |
| 7 | flange |
| 8 | inlay |

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A pump housing, comprising:
a first casing;
a second casing; and
a space filling material,
wherein
the first and second casings are made of plastic,
the first and second casings are configured such that when positioned adjacent to one another a space exists between the first and second casings,
the space-filling material is located in the space between the first and second casings,
at least one part of the pump housing is formed from a plurality of segments, each of the plurality of segments being formed from a pair of the first and second casings the plurality of segments have no undercuts,
the plurality of segments are configured to be connected to one another by connection flanges,
the plurality of segments includes at least two geometrically identical segments.

2. The pump housing as claimed in claim 1, wherein the filling material is a self-expanding foam.

3. The pump housing as claimed in claim 1, wherein the filling material is a composite material.

4. The pump housing as claimed in claim 1, further comprising:
reinforcing elements configured to be located in the space between the first and second casings.

5. The pump housing as claimed in claim 1, wherein at least one of the first and second casings is made of a fiber-reinforced composite material which includes fibers and a matrix containing the fibers.

6. The pump housing as claimed in claim 5, wherein the fibers are at least one of glass, carbon, boron and aramid.

7. The pump housing as claimed in claim 6, wherein the matrix is made of a thermoplastic or thermoset plastic.

8. The pump housing as claimed in claim 1, wherein the pump housing includes plastic and metal components.

9. The pump housing as claimed in claim 1, wherein at least one of the first and second casings includes a fluid-impermeable coating.

10. The pump housing as claimed in claim 9, wherein the fluid-impermeable coating is an epoxy-resin.

11. The pump housing as claimed in claim 1, further comprising:
reinforcing elements configured to be located in the space between the first and second casings,
wherein
the filling material is a self-expanding foam, and
at least one of the first and second casings is made of a fiber-reinforced composite material which includes fibers of at least one of glass, carbon, boron and aramid and a matrix of a thermoplastic or thermoset plastic containing the fibers, and
at least one of the first and second casings includes a fluid-impermeable epoxy-resin coating.

* * * * *